US006906628B2

(12) United States Patent
Whitehead

(10) Patent No.: US 6,906,628 B2
(45) Date of Patent: Jun. 14, 2005

(54) VARYING FIELD ELECTRONIC TAG DETECTION SYSTEM

(75) Inventor: James T. Whitehead, Coconut Creek, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 186 days.

(21) Appl. No.: 09/805,268

(22) Filed: Mar. 13, 2001

(65) Prior Publication Data

US 2002/0130244 A1 Sep. 19, 2002

(51) Int. Cl.[7] ..... G08B 13/14

(52) U.S. Cl. ..... 340/572.1; 340/551; 340/10.2; 340/10.34

(58) Field of Search ..... 340/572.1, 572.2, 340/571, 552, 572.4, 572.7, 551, 561, 572.8, 572.9, 10.2, 10.31, 10.32, 10.33, 10.34

(56) References Cited

U.S. PATENT DOCUMENTS 5,049,857 A * 9/1991 Plonsky et al. ..... 340/551
5,130,697 A * 7/1992 McGinn ..... 340/572.1
5,276,430 A * 1/1994 Granovsky ..... 340/572.1
5,406,262 A * 4/1995 Herman et al. ..... 340/572.1
5,703,566 A * 12/1997 Weaver ..... 340/572.1
5,760,580 A * 6/1998 Tyren ..... 340/551
5,777,561 A * 7/1998 Chieu et al. ..... 340/10.32
6,127,928 A * 10/2000 Issacman ..... 340/572.1
6,400,273 B1 * 6/2002 Bettine ..... 340/572.4
6,417,771 B1 * 7/2002 Tyren ..... 340/572.2
6,486,655 B1 * 11/2002 Crossfield ..... 340/870.33

FOREIGN PATENT DOCUMENTS

| | | | |
|---|---|---|---|
| EP | 1008972 A2 | 6/2000 | ..... G08B/13/24 |
| GB | 1604220 | 12/1981 | ..... H04B/1/59 |
| JP | 10021351 | 1/1998 | ..... G06K/17/00 |
| JP | 10302031 | 11/1998 | ..... G06K/17/00 |

* cited by examiner

*Primary Examiner*—Jeffrey Hofsass
*Assistant Examiner*—Daniel Previl

(57) ABSTRACT

The invention concerns a system for detecting multiple tags in a detection zone. The system includes an electronic tag detection system having first and second field generators, each having a respective antenna for generating an electromagnetic field in a detection zone defined between the antennas. Additionally, at least one of the field generators can be responsive to a presence of at least two electronically detectable tags in the detection zone, for varying an intensity of at least one of the electromagnetic fields.

20 Claims, 5 Drawing Sheets

VARYING FIELD ELECTRONIC TAG DETECTION SYSTEM

FIELD OF THE INVENTION

This invention relates to the field of electronic tag detection systems, and more particularly, to electronic article surveillance systems and asset tracking systems in which magnetic radiation or energy is used for detection of electronic tags.

BACKGROUND OF THE INVENTION

Electronic tag detection systems include article surveillance systems and asset tracking systems, and are known in the art wherein tag detection is carried out by transmitting an electromagnetic field into a detection zone. In these systems, determining the presence of the articles under surveillance is accomplished by sensing perturbations to the transmitted electromagnetic field. Perturbations to the transmitted electromagnetic field are generated by electronically detectable tags attached to or incorporated into the articles. These tags carry or are formed from magnetic markers, materials, or circuits, which create the perturbations, and can be simple tags or complex tags, and may carry one or more bits of data.

One type of electronic tag detection system utilizes a single magnetic field and simple tags. Simple tags employ no multi-tag algorithms. For example, such tags are not addressable and cannot vary transmission times. In single field systems utilizing simple tags, a single antenna is placed on one side of an opening. Ideally, the antenna transmits a magnetic field of a particular minimum intensity, which occupies the entire opening. A receiving antenna is placed opposite the transmitting antenna on the opposing side of the opening. The area between the transmitting antenna and the receiving antenna is called the detection zone. Alternatively, a transceiver system can be employed wherein the transmitting antenna and the receiving antenna are located within the same physical housing on one side of the opening. In either case, the resulting magnetic field from the transmitting antenna is effective for triggering a response from simple tags passing through the detection zone. For example, the magnetic field has a minimum intensity required to trigger a response from a tag passing through the magnetic field. When a tag attached or incorporated into an article passing through the detection zone is exposed to a magnetic field having a particular frequency and magnetic field intensity, the tag causes perturbations in the magnetic field. These perturbations are typically in the form of harmonics of the fundamental frequency of the magnetic field, which can be detected by the receiving antenna.

One significant problem with single field electronic tag detection systems using simple tags is the system's inability to detect more than one tag within the detection zone at one time. For example, when two tags are present in the detection zone at the same time, each tag simultaneously generates perturbation energy that is received by the receiving antenna. Although the antenna receives the perturbation energy in the form of harmonics of the fundamental frequency of the magnetic field from both of the tags concurrently, the tags interfere with one another. Such interference between the tags results in the system receiving corrupted data. Consequently, the system is unable to determine whether a tag has passed through the detection zone.

Another type of electronic tag detection system utilizes two magnetic fields and simple tags. In this system, a transceiver is located on one side of an opening, and a second transceiver is located on the opposite side of the opening. The area between the two transceivers is referred to as the detection zone. The two transceivers are tuned so that the transmitting antenna of each transceiver transmits a magnetic field extending to the middle of the detection zone. The two magnetic fields do not overlap or under-lap each other. Moreover, no portion of the detection zone is left unoccupied by a magnetic field. Thus, if two tags pass through the detection zone at one time, use of a two magnetic field system increases the likelihood that one tag will pass through the left magnetic field and the second tag will pass through the right magnetic field. Consequently, the likelihood of receiving corrupted data due to more than one tag passing through a single magnetic field at one time is decreased.

There are however significant problems with two field electronic tag detection systems. One problem is that two field systems cannot detect more than two tags within the detection zone at one time. If three or more tags pass through the detection zone, then at least two tags will pass through a single magnetic field. As was the case with single field electronic tag detection systems, two tags within a single magnetic field interfere with one another. Consequently, the system receives corrupted data. Another problem is that two field systems rely on the contingency that if two tags pass through the detection zone simultaneously, each tag will pass through a different magnetic field. For example, such systems will receive valid data only if one tag passes through the left magnetic field while the second tag passes through the right magnetic field. However, as the size of the detection zone increases, the size of the magnetic fields necessary to occupy the detection zone increase as well. Consequently, the likelihood of two tags passing through the same magnetic field simultaneously increases with the size of the detection zone. Thus, the benefits of a two field electronic article surveillance system are not realized as the detection zone becomes larger.

In the known art, U.S. Pat. No. 5,049,857 (the '857 patent) discloses a magnetic article surveillance system and is incorporated herein by reference. The '857 patent switches between a transmit/receive mode and a transceiver mode to better distinguish electronic tags from items that may cause false alarms. The surveillance system utilizes a transmitter for transmitting magnetic energy into a detection zone and a receiver for receiving magnetic energy from the detection zone, and alternately a transceiver performing the same functions as the transmitter and receiver. The transmit/receive mode and the transceiver modes each provide different detection characteristics for determining false alarms, which the '857 patent takes advantage of by incorporating both for detection. Electronically detectable tags passing through the detection zone are detected by the system even in the presence of interfering materials. The '857 does not, however, teach how to differentiate multiple valid tags in the detection zone. It should be appreciated that magnetic article surveillance systems and asset tracking systems utilizing transmitters and receivers and/or transceivers for receiving and transmitting magnetic energy into a detection zone for the detection of electronically detectable tags are known in the art.

As such, electronic tag detection systems using simple tags suffer from the deficiency of not being able to reliably detect more than one tag within the detection zone at one time. As a result, there has arisen a need for an electronic article surveillance system capable of detecting multiple tags in a detection zone without using complex multi-tag algorithms.

SUMMARY OF THE INVENTION

The invention is a system for detecting multiple electronically detectable tags in a detection zone. The system includes an electronic tag detection system, comprising first and second field generators, each having a respective antenna for generating an electromagnetic field in a detection zone defined between the antennas. Additionally, at least one of the field generators can be responsive to a presence of at least two electronically detectable tags in the detection zone, for varying an intensity of at least one of the electromagnetic fields. Also, the intensity of at least one of the electromagnetic fields can be varied by adjusting an amplitude of electric power delivered to the antenna of the field generator producing the magnetic field.

In one embodiment of the invention, at least one of the field generators varies the intensity of at least one of the electromagnetic fields in response to a receipt of corrupted data from at least one of the two electronically detectable tags in the detection zone. The system can further include a controlling means for making a detection of the presence of at least two electronically detectable tags in the detection zone and for controlling the varying of the intensities of the electromagnetic fields in response to the detection. Preferably, the first and second field generators can be responsive to the presence of at least two electronically detectable tags in the detection zone.

The system can include a second one of the field generators, which can vary an intensity of a second one of the electromagnetic fields in response to the presence of at least two electronically detectable tags in the detection zone. Preferably, the intensity of the first electromagnetic field can be varied in inverse proportion to the intensity of the second electromagnetic field.

The system can further include an outer perimeter of each electromagnetic field being defined by a minimum field intensity necessary to detect one of the electronically detectable tags. Additionally, the perimeters of the first and second electromagnetic fields can abut each another. In another embodiment of the invention, each of the field generators can be responsive to the presence of at least one electronically detectable tag within the perimeter of its associated electromagnetic field. Preferably, in response to a detection of the presence of at least two electronically detectable tags within the detection zone, at least one of the field generators can vary the intensity of at least one of the electromagnetic field intensities until there is no more than one electronically detectable tag within the perimeter of the associated antenna generating the field. Also, in response to the detection of the presence of at least two electronically detectable tags in the detection zone, a second one of the field generators can vary an intensity of a second one of the electromagnetic fields until there is no more than one electronically detectable tag within the perimeter of the associated antenna generating the field. Preferably, at least one of the electromagnetic fields can be varied in both small and large steps. Alternatively, at least one of the electromagnetic fields can be varied first in large steps and then in small steps.

In another embodiment of the invention, the invention can include third and fourth field generators, each having a respective antenna for generating an electromagnetic field in the detection zone, wherein the third antenna is located vertically above the horizontal plane of the tops of the first, second, and fourth antennas, and the fourth antenna is located vertically below the horizontal plane of the bottoms of the first, second, and third antennas. Preferably, the electromagnetic fields generated by the third and fourth antennas are perpendicular to the fields of the first and second antennas.

In yet another embodiment of the invention, no wires connect each of the field generators to one another, and no wires connect each of the antennas to one another.

Unless otherwise defined, all technical and scientific terms used herein have the same meaning as commonly understood by one of ordinary skill in the art to which this invention belongs. Although methods and materials similar or equivalent to those described herein can be used in the practice or testing of the present invention, the preferred methods and materials are described below. All publications, patent applications, patents, and other references mentioned herein are incorporated by reference in their entirety. In case of conflict, the present specification, including definitions, will control. In addition, the materials, methods, and examples are illustrative only and not intended to be limiting. Other features, advantages, and objects of the invention will be apparent from the following detailed description, and from the claims.

BRIEF DESCRIPTION OF THE DRAWINGS

There are presently shown in the drawings embodiments which are presently preferred, it being understood, however, that the invention is not so limited to the precise arrangements and instrumentalities shown, wherein.

DETAILED DESCRIPTION OF THE INVENTION

Figure 1:
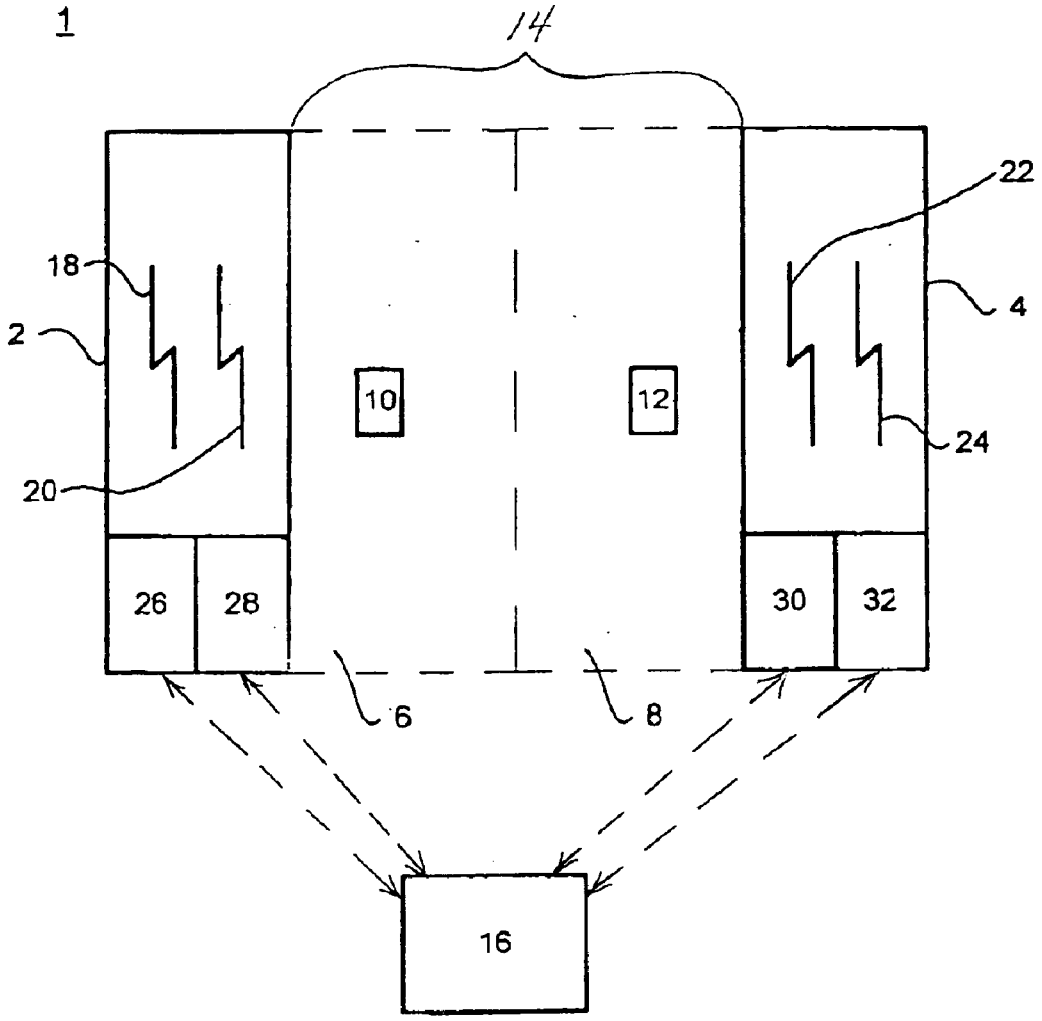
FIG. 1 depicts a general configuration of one embodiment of the present invention.

An electronic tag detection system according to one embodiment of the present invention is illustrated in FIG. 1. System 1 is to be employed to detect the presence of at least two tags, 10 and 12, passing through a detection zone 14. Tags 10 and 12 are electronically detectable and formed from magnetic markers, materials, or circuits capable of creating perturbations in electromagnetic fields. Magnetic materials can be in strip, wire, or other form. In one embodiment used as an example herein, the magnetic material creates perturbations at harmonics of the fundamental frequency of a transmitted magnetic field. Although the system disclosed herein can be used with simple tags, the invention is not so limited. Moreover, it should be appreciated by those skilled in the art that the present invention can be used with tags equipped with complex multi-tag algorithms. For example, such tags can be addressable or capable of varying transmission times wherein the tag is effectively turned off.

System 1 is further comprised of transceivers 2 and 4. Transceivers 2 and 4 each contain the following components respectively: transmitting antennas or coils 18 and 24, receiving antennas or coils 20 and 22, field generators 26 and 32, and receivers 28 and 30. Each transmitting antenna 18 and 24 is capable of transmitting a magnetic field into the detection zone 14, which is defined as the area between transceivers 2 and 4. Magnetic field 6 is generated from transmitting antenna 18 and magnetic field 8 is generated from transmitting antenna 24.

Magnetic fields 6 and 8 transmitted from transmitting antennas 18 and 24 respectively occupy detection zone 14. Throughout detection zone 14, each of magnetic fields 6 and 8 has a minimum field intensity required to detect tags 10 and 12. The boundary of each magnetic field 6 and 8 having the minimum magnetic field intensity required to detect tags 10 and 12 is referred to as the perimeter of the magnetic field. Within the detection zone 14, a portion of the perimeter of magnetic field 6 abuts a portion of the perimeter of magnetic field 8. For example, transmitting antenna 18 transmits magnetic energy producing magnetic field 6, which extends from transceiver 2 toward transceiver 4. Transmitting antenna 24 transmits magnetic energy producing magnetic field 8, which extends from transceiver 4 toward transceiver 2. Magnetic fields 6 and 8 each have perimeters defined by the minimum field intensity required to detect tags 10 and 12. The perimeters of magnetic fields 6 and 8 abut one another in the center of detection zone 14 and preferably do not overlap one another. However, some degree of overlap can be within acceptable tolerances of the invention if such overlap would not hinder the system's performance. For example, if a tag can still be detected even though the tag passes through an area of magnetic field overlap within the detection zone, then that amount of overlap would be within acceptable system tolerances. Additionally, the perimeters of magnetic fields 6 and 8 preferably do not under-lap one another, meaning that preferably no spaces or gaps exist between the perimeters of the two magnetic fields 6 and 8 in detection zone 14. However, it should be appreciated by those skilled in the art that there may be a gap or space between the perimeters of magnetic fields 6 and 8 if the presence of such a gap is inconsequential to the system's performance. For example, one or more gaps having a particular size may exist between the perimeters of magnetic fields 6 and 8. Such particularly sized gaps can be within acceptable system tolerances if a tag passing through any of the gaps can still be detected by the invention.

An alternative measure of acceptable overlap or under-lap between magnetic fields 6 and 8 can be that the system have at least a particular tag detection accuracy rate. For example, if the system achieves a tag detection rate of 90%, then the amount of overlap or under-lap between the magnetic fields would be within acceptable tolerances.

Field generators 26 and 32 are operatively connected to transmitting antennas 18 and 24 respectively. In response to control signals received from controller 16, each field generator is capable of supplying varying amounts of electrical power to its respective transmitting antenna. The electrical power supplied from each magnetic field generator is in the form of an AC drive signal having a fundamental frequency of $F_0$. Preferably, the power supplied from each magnetic field generator to its respective transmitting antenna is sufficient to generate a magnetic field having a perimeter large enough to occupy the entire detection zone 14.

Receiving antennas 20 and 22 located in transceivers 2 and 4 respectively, are capable of detecting perturbations in magnetic fields 6 and 8 caused by the presence of tags 10 and 12. Each of receiving antennas 20 and 22 is operatively connected to receivers 28 and 30 respectively. Receivers 28 and 30 are capable of extracting signal information detected by receiving antennas 20 and 24 respectively. Preferably, each receiver is capable of extracting the fundamental frequency $F_0$, as well as the second and third harmonics $2F_0$ and $3F_0$. Additionally, each receiver can provide an output signal to be sent to controller 16.

Controller 16 is operatively connected to each of transceivers 2 and 4 so that data may be sent or received from each field generator 26 and 32 as well as each receiver 28 and 30. This connection may be via data cable. Preferably, the data connection is a wireless communication link between controller 16 and transceivers 2 and 4. This communication link enables controller 16 to receive signal information from receivers 28 and 30. Controller 16 is further capable of analyzing the signal information using commonly known processing algorithms to determine whether valid or corrupt data has been received. Valid data is received when a single tag exists within a single magnetic field. Corrupt data results when two tags are present within a single magnetic field. Based upon whether the signal information indicates corrupt or valid data, controller 16 can send control signals to each of transceivers 2 and 4 to be received by each respective field generator. The control signals instruct each field generator whether to increase, decrease, or maintain constant the amount of electrical power supplied to each field generator's respective transmitting antenna. Preferably, through the use of control signals, controller 16 can vary the magnetic field strength transmitted by transmitting antenna in transceiver 2 and the transmitting antenna in transceiver 4 in a cooperative manner. For example, controller 16 can send appropriate control signals to each field generator within transceiver 2 and 4 for varying the intensity of magnetic field 6 and magnetic field 8 in a manner inversely proportional to one another.

Preferably, transceiver 2 is located on one side of an opening or entrance. Transceiver 4 is placed at the opposing side of the opening or entrance from transceiver 2. Field generators 26 and 32, as well as receivers 28 and 30 are illustrated as being located within transceivers 2 and 4 respectively, but may be separate components.

Figure 2:
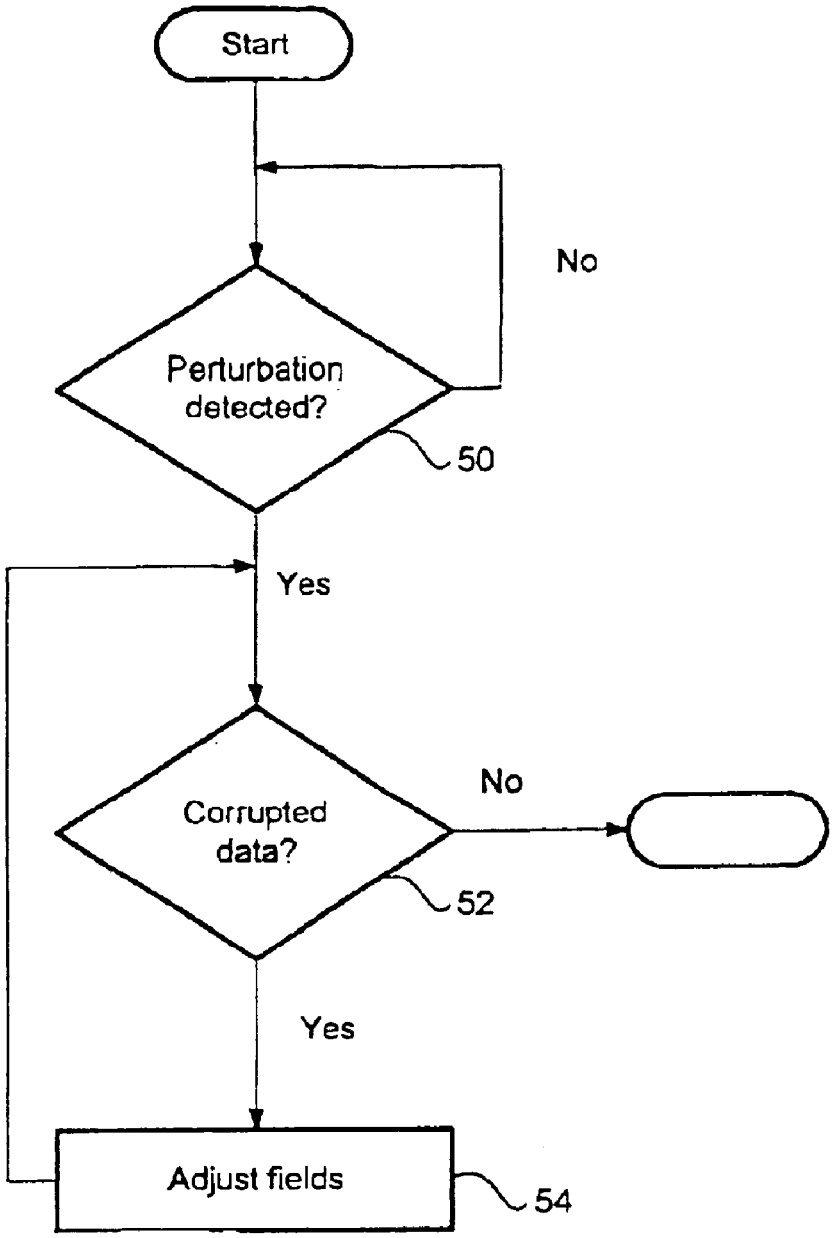
FIG. 2 is a flow chart illustrating the operation of the inventive system disclosed herein.

FIG. 2 is a flow chart illustrating the operation of the system disclosed herein. Beginning with step 50, the system enters a state awaiting any perturbation in either magnetic field 6 or 8. If the system does not detect a perturbation in either field, then the system loops back to step 50 again. The system continues to loop until such time that the system detects a perturbation in either magnetic field 6 or 8. Such a perturbation in either magnetic field 6 or 8 can be detected by either receiving antenna 20 or 22 respectively. Perturbations detected by receiving antenna 20 are processed by receiver 28. Similarly, perturbations detected by receiving antenna 22 are processed by receiver 30. After the detected signal is processed through either receiver 28 or receiver 30, the resulting signal information is sent to controller 16. If the system does detect a perturbation in either magnetic field 6 or 8, then the system continues to step 52.

Figure 3:
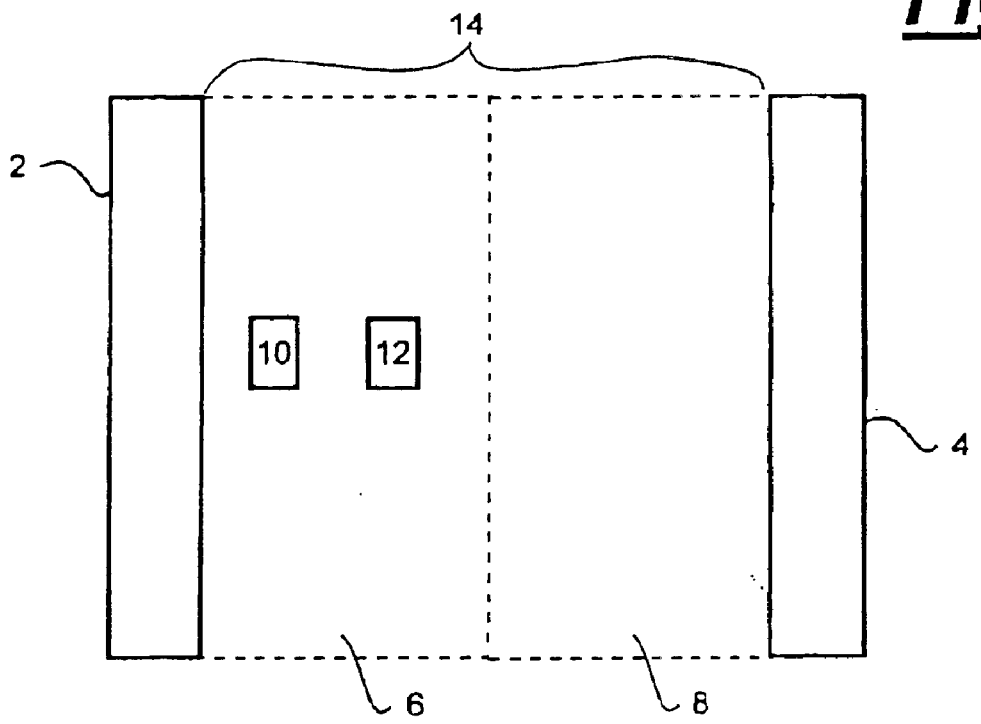
FIG. 3 depicts the condition of having two tags within a single electromagnetic field.

In step 52 the system determines whether corrupt or valid data has been received by the system. Controller 16 analyzes any signal data from transceivers 2 and 4 and makes a determination whether valid data or corrupt data has been received. If the system receives no corrupt data from either transceiver 2 or 4, then the system has detected a single tag in one of the magnetic fields or a single tag in each of the magnetic fields. In either case, the process is done. If not, then the corrupt data indicates that more than one tag was detected in a single magnetic field. For example, if two tags were located within either one of the magnetic fields 6 or 8, then the respective receiving antenna would detect a perturbation in the magnetic field caused by two tags interfering with one another. In this case, controller 16 interprets the signal information received as a result of two tags being present within a single magnetic field as corrupted data. FIG. 3 illustrates such a condition where two tags simultaneously pass through detection zone 14 within magnetic field 6. If the system detects corrupted data, then the system continues to step 54.

Figure 4:
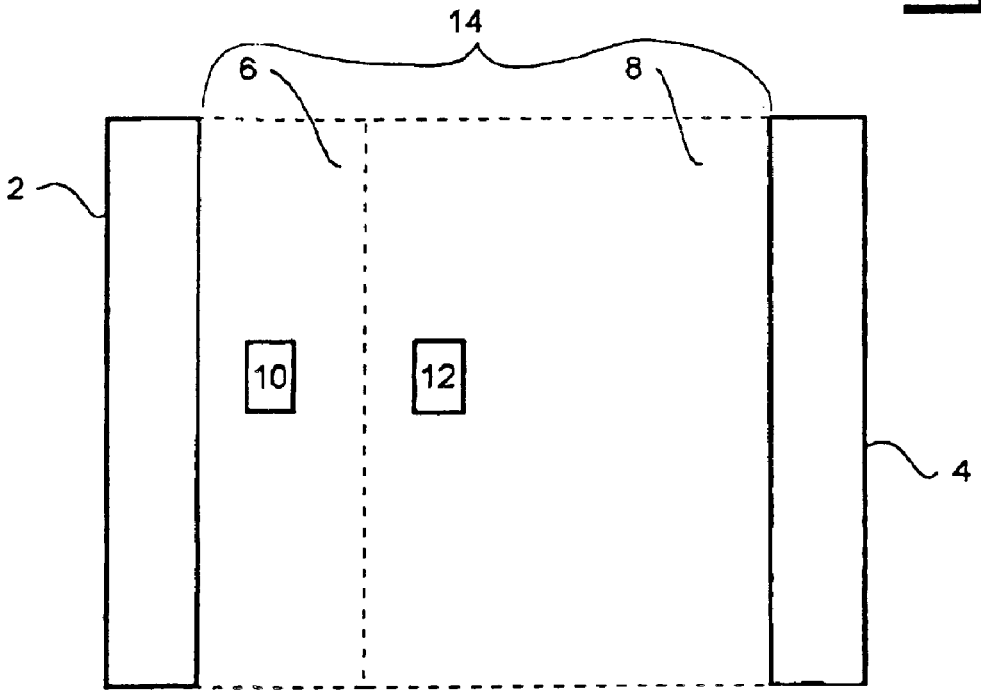
FIG. 4 depicts the system response after detecting two tags within a single electromagnetic field.

In step 54, controller 16 sends control signals to each of field generators 26 and 32. The control signals direct the field generators to vary the power supplied to transmitting antennas 18 and 24 in a manner inversely proportional to one another. For example, by decreasing the power supplied to transmitting antenna 18 and increasing the power to transmitting antenna 24, the resulting magnetic field perimeters of magnetic fields 6 and 8 change in a cooperative manner. Thus, because the magnetic field intensity of magnetic field 6 decreases, the perimeter of magnetic field 6 retreats toward transceiver 2. Further, because the magnetic field intensity of magnetic field 8 increases, the perimeter of magnetic field 8 extends toward transceiver 2. The result is that the boundary between the two magnetic field perimeters changes. Preferably the perimeters of magnetic fields 6 and 8 will come together so as not to overlap or under-lap each other. However, a particular amount of overlap or under-lap between magnetic fields 6 and 8 would be acceptable if within the stated tolerances of the system. FIG. 4 illustrates such a situation where the intensity of magnetic fields 6 and 8 has been modified in a manner inversely proportional to one another resulting in tag 10 being located in magnetic field 6 and tag 12 being located in magnetic field 8.

After step 54, the system loops back to step 52 where controller 16 again determines whether the signal information received from receivers 28 and 30 represents valid data or corrupted data. If the magnetic fields have been adjusted so that only one tag is present in a single magnetic field, as is illustrated in FIG. 4, then the system is done. However, if the system again detects corrupted data, then the system continues to step 54 and further adjusts the power to each antenna in a manner inversely proportional to one another.

Figure 5:
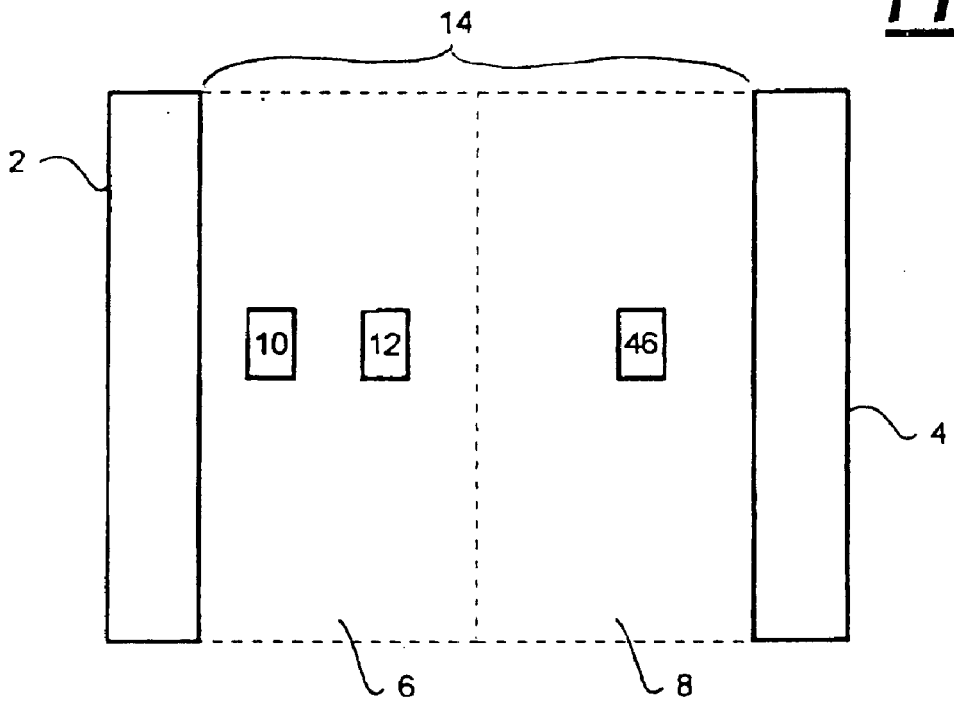
FIG. 5 depicts the condition of having two tags within a single electromagnetic field while a single tag is simultaneously within the other electromagnetic field.

FIG. 5 illustrates another situation where the system can receive corrupt data due to the presence of more than two tags in the detection zone. In FIG. 5, the presence of a single tag 46 in magnetic field 8 causes valid data to be sent from transceiver 4. However, the presence of two tags 10 and 12 in magnetic field 6 will cause transceiver 2 to send corrupt data to controller 16. Consequently, because the system has detected corrupt data, the system will still proceed to step 54. It should be appreciated by those skilled in the art that the system can be capable of rendering the validly detected tag inoperative after correctly detecting the tag. It should further be appreciated that the method of rendering a tag inoperative is not limited to detection of three tags, but can be used for detection of a multitude of tags in the detection zone. For example, after detecting tag 46, the system can filter signals received from tag 46. Alternatively, in the case of tags having multi-tag algorithms, in response to a signal from transmitting antenna 24, tag 46 can be turned off so that no signal or perturbation energy is caused by or transmitted from tag 46. In either case, once the system correctly detects tag 46, the system can render the tag invisible to the system. Consequently, the system can proceed to step 54 to adjust magnetic fields 6 and 8 for detecting tags 10 and 12.

The system continues to loop through step 54 until only one tag is present in a single magnetic field. In step 54, the system can first vary the magnetic field intensities in either large or small increments. For example, when the system first detects corrupt data, the system can vary the magnetic field intensities in large increments. Then, during subsequent iterations through step 54, variations in the intensity of magnetic fields 6 and 8 can be made in smaller increments until all data conflicts have been resolved.

Figure 6:
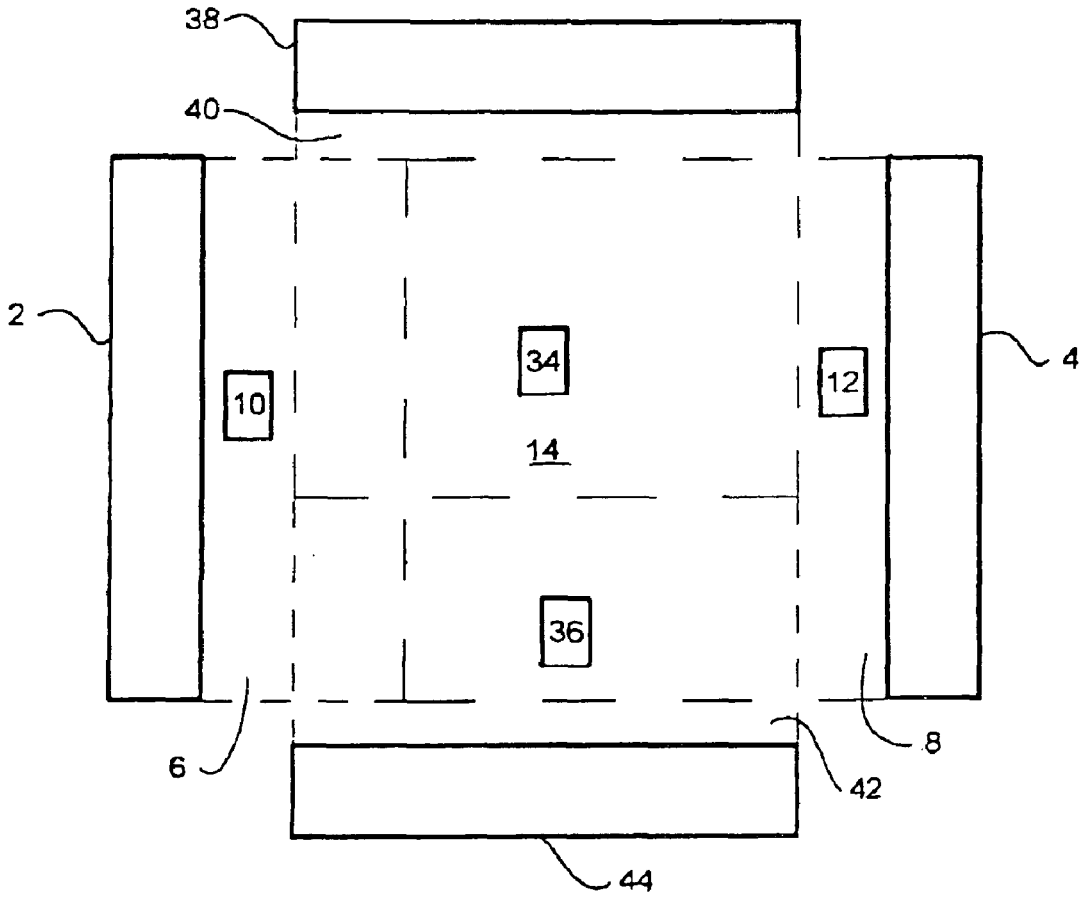
FIG. 6 depicts an alternate embodiment of the present invention for use with tags at differing heights.

FIG. 6 illustrates an embodiment of the invention for use with multiple tags at differing heights. The embodiment of FIG. 6 is similar to the embodiment of FIG. 1 with certain changes. Additional transceivers 38 and 44 have been added to the top and bottom of the opening respectively. Transceiver 38 is located vertically above the horizontal plane of the tops of transceivers 2 and 4. Transceiver 44 is located vertically below the horizontal plane of the bottom of transceivers 2 and 4. Transceivers 38 and 44 can be identical to transceivers 2 and 4, respectively. In this case, the detection zone is now defined by the area between each of the transceivers 2, 4, 38, and 44.

Each of transceivers 38 and 44 can be operatively connected to controller 16 for communication and control in the same manner as transceivers 2 and 4, respectively. Magnetic field 40 is produced by a transmitting antenna in transceiver 38 and magnetic field 42 is produced by a transmitting antenna in transceiver 44. The perimeter of magnetic fields 42 and 40 abut one another within detection zone 14 in the same manner as described for magnetic fields 6 and 8. Operation of the preferred embodiment of FIG. 5 is similar to operation described in detail already. Notably, transceivers 38 and 44 can be controlled via control signals from controller 16 in a cooperative manner. For example, similar to the operation of transceivers 2 and 4, transceivers 38 and 44 can emit magnetic fields 40 and 42, which can vary in a manner inversely proportional to one another. The magnetic fields 40 and 42 are substantially perpendicular to magnetic fields 6 and 8. FIG. 5 depicts the condition wherein after cooperatively adjusting magnetic field 40 with magnetic field 42 and magnetic field 6 with magnetic field 8, each of tags 10,12, 34, and 36 is located in magnetic fields 6, 8, 40, and 42 respectively. In this case, controller 16 would receive signal data indicating valid data.

It should be understood that the examples and embodiments described herein are for illustrative purposes only and that various modifications or changes in light thereof will be suggested to persons skilled in the art and are to be included within the spirit and purview of this application. The invention can take other specific forms without departing from the spirit or essential attributes thereof for an indication of the scope of the invention.

What is claimed is:

1. An electronic tag detection system for detecting multiple electronically detectable tags in a detection zone, comprising:

first and second field generators, each having a respective antenna for generating an electromagnetic field in a detection zone defined between said antennas; and, at least one of said field generators being responsive to a presence of at least two electronically detectable tags in said detection zone, for varying an intensity of at least one of said electromagnetic fields so that only one of said electronically detectable tags is detected in said varied electromagnetic field.

2. A system in accordance with claim 1, wherein the intensity of at least one of said electromagnetic fields is varied by adjusting an amplitude of electric power delivered to the antenna of the field generator producing said electromagnetic field.

3. A system in accordance with claim 1, wherein at least one of said field generators varies said intensity of at least one of said electromagnetic fields in response to a receipt of corrupted data from at least one of said two electronically detectable tags in said detection zone.

4. A system in accordance with claim 1, further comprising:

a controlling means for detecting the presence of at least two electronically detectable tags in said detection zone and for varying intensities of said electromagnetic fields in response to said detection.

5. A system in accordance with claim 1, wherein said first and second field generators are responsive to the presence of at least two electronically detectable tags in said detection zone.

6. A system in accordance with claim 1, wherein a second one of said field generators varies an intensity of a second one of said electromagnetic fields in response to the presence of at least two electronically detectable tags in said detection zone.

7. A system in accordance with claim 6, wherein the intensity of each of said electromagnetic fields is varied in inverse proportion to each other.

8. A system in accordance with claim 1, wherein an outer perimeter of each of said electromagnetic fields is defined by a minimum field intensity necessary to detect one of said electronically detectable tags.

9. A system in accordance with claim 8, wherein a portion of said perimeters of each of said electromagnetic fields substantially abut each another.

10. A system in accordance with claim 8, wherein each of said field generators is responsive to the presence of at least one electronically detectable tag within the perimeter of its associated electromagnetic field.

11. A system in accordance with claim 10, wherein in response to a detection of at least two electronically detectable tags within said detection zone, at least one of said field generators varies the intensity of at least one of said electromagnetic fields until there is no more than one electronically detectable tag within the perimeter of the associated electromagnetic field.

12. A system in accordance with claim 11, wherein in response to said detection presence of at least two electronically detectable tags in said detection zone, a second one of said field generators varies an intensity of a second one of said electromagnetic fields until there is no more than one electronically detectable tag within the perimeter of the associated electromagnetic field.

13. A system in accordance with claim 1, wherein at least one of said electromagnetic fields is varied in both small and large steps.

14. A system in accordance with claim 1, wherein at least one of said electromagnetic fields is varied first in large steps and then in small steps.

15. A system in accordance with claim 1, further comprising:

third and fourth field generators, each having a respective antenna for generating an electromagnetic field in said detection zone, wherein said third antenna is located vertically above said first, second, and fourth antennas, and said fourth antenna is located vertically below said first, second, and third antennas; and, said electromagnetic fields generated by said third and fourth antennas are substantially perpendicular to the fields of said first and second antennas.

16. A system in accordance with claim 1, wherein no wires connect each of said fields generators to one another, and no wires connect each of said antennas to one another.

17. A method for detecting multiple electronically detectable tags in a detection zone, comprising:

providing first and second field generators, each having a respective antenna for generating an electromagnetic field in a detection zone defined between said antennas, varying an intensity of at least one of said electromagnetic fields by at least one of said field generators being responsive to a presence of at least two electronically detectable tags in said detection zone.

18. The method of claim 17 further comprising varying said intensity of at least one of said electromagnetic fields in response to a receipt of corrupted data from at least one of said two electronically detectable tags in said detection zone.

19. The method of claim 18 further comprising varying an intensity of a second one of said electromagnetic fields in response to the presence of at least two electronically detectable tags in said detection zone.

20. The method of claim 19 wherein the intensity of each of said electromagnetic fields is varied in inverse proportion to each other.

* * * * *